United States Patent [19]

Gerch

[11] Patent Number: 4,805,749

[45] Date of Patent: Feb. 21, 1989

[54] DUFFEL TYPE SPORTS BAG

[75] Inventor: Edward L. Gerch, Evanston, Ill.

[73] Assignee: Kingport International Corporation, Evanston, Ill.

[21] Appl. No.: 656,255

[22] Filed: Oct. 1, 1984

[51] Int. Cl.[4] ..... A45C 3/00

[52] U.S. Cl. ..... 190/111; 190/103; 190/109; 190/112; 150/112; 150/117; 383/2

[58] Field of Search ..... 190/102, 103, 104, 105, 190/107, 109, 111, 112; 150/106, 112, 114, 117; 383/2

[56] References Cited

U.S. PATENT DOCUMENTS

| | | | |
|---|---|---|---|
| 2,394,332 | 2/1946 | Salem | 190/102 |
| 2,577,670 | 12/1951 | Adams | 190/111 |
| 2,597,194 | 5/1952 | Scholl | 190/111 |
| 3,122,225 | 2/1964 | Ward | 190/109 |
| 3,410,376 | 11/1968 | Benzel | 190/109 |
| 3,955,609 | 5/1976 | Siegel | 150/114 |
| 4,153,093 | 5/1979 | Mahabir | 150/106 |
| 4,171,011 | 10/1979 | Kopin | 150/34 |
| 4,210,186 | 7/1980 | Belenson | 190/111 |
| 4,236,615 | 12/1980 | Ginat | 190/52 |
| 4,301,898 | 11/1981 | Plough et al. | 190/102 |
| 4,334,601 | 6/1982 | Davis | 190/111 |

FOREIGN PATENT DOCUMENTS 2374866 7/1978 France ..... 45/7

*Primary Examiner*—David T. Fidei

*Attorney, Agent, or Firm*—Hill, Van Santen, Steadman & Simpson

[57] ABSTRACT

An improved tube shape duffel-type travel or sports bag is disclosed which features an oblong softsided central compartment having access through the top thereof, and a pair of matching smaller compartments, one each on the opposing ends of the oblong central compartment. The opposing compartments have circumferential zippered openings therearound. In the improvement of the invention one of the end compartments includes a plurality of pockets/dividers therein for selective positioning of user materials in each as desired. The opposing smaller compartment on the opposite end of the bag includes therein an expansible wall constructed in connection and cooperation with one end wall of the main central compartment. The expansible wall includes a collapsible pocket, preferably made of waterproof material, which is capable of extending into the main compartment and expanding therein as desired, preferably for positioning worn clothing or accessories therein.

11 Claims, 2 Drawing Sheets

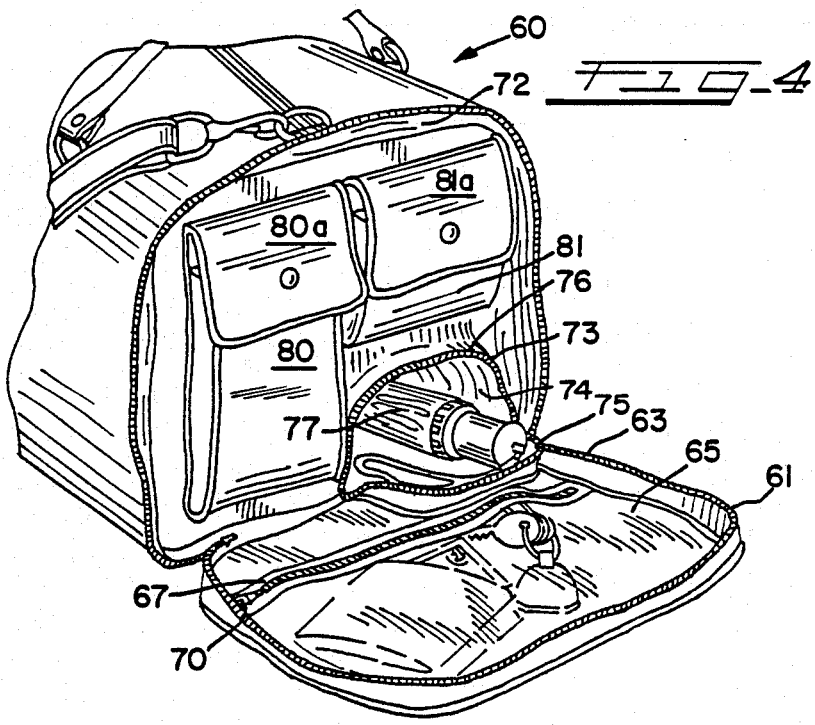
FIG. 4
FIG. 5
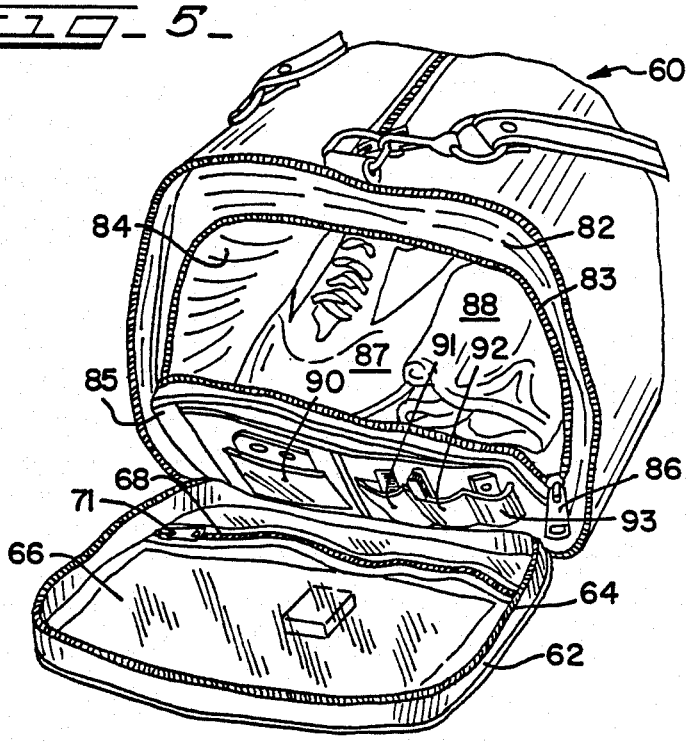

DUFFEL TYPE SPORTS BAG

BACKGROUND OF THE INVENTION

The present invention relates generally to improvements in travel or sports bags shaped like duffel or roll-type bags. More particularly, the invention relates to improvements in an elongate sports bag which has a large central storage compartment and opposing small end compartments, with one having organizer-type pockets therein and the other being an expansible substantially waterproof compartment, preferably used for storing worn clothes therein.

Duffel or roll-type bags are presently enjoying popularity because of their sporting nature and their natural soft-sided features, which also find popularity in everyday travelwear as well as in sporting luggage. As in known arch-shape sporting bags, there is a need for providing a substantially waterproof compartment in which to store already worn clothing and accessories, such as swim suits, gym shoes, and the like. However, in known arch-shape gym or sporting bags, it was known to have a substantially waterproof area positioned adjacent to the bottom of the bag along a longitudinal opening extending alongside of the bag. With respect to the roll-type bag, such a longitudinal opening is impractical as the sides of the elongated bag are generally stressed by strap-type handles. Additionally, modern sporting-type bag users are more likely to be leading a more complex life style than users of the old high school type sporting bags. It would not be uncommon for a modern sporting bag user to use the bag in connection with a trip to the handball or racquet ball court before going to the office in the morning or during a lunch break. Additionally, if the sporting-type bag is to be used in connection with a business trip, or the like, there is a need for additional organizer-type storage compartments in the bag. Therefore, a need has developed for an improved duffel or roll-type sports bag.

Heretofore known duffel or roll-type sports bags having additional compartments at the opposing ends thereof are disclosed in U.S. Pat. No. 4,334,601 and French Pat. No. 2,374,866. Bags or cases having expandable compartments exposed to an exterior end surface thereof are found at U.S. Pat. Nos. 4,171,011 and 4,236,615.

SUMMARY OF THE INVENTION

The invention is directed to a tube-like travel or sports bag of the type made of pliable material and including a main storage compartment having two like-shape opposed compartment end panels and a first generally rectangular side wall being rolled for connection at is opposed ends to the periphery of respective ones of those end panels. The entire combination defines at least a portion of the boundaries of a main storage compartment in the sports bag. An opening in a first sidewall of the main storage compartment provides access to that compartment, and the opening is provided with a closure means. The bag includes means mounted on the main compartment sidewall for user carrying of same. A second rolled sidewall extends laterally from a joinder between the first sidewall and one of the first compartment end panels, and the third like-shape end panel is connected to a peripheral end of the second sidewall forming a second compartment on the bag. An opening in the second sidewall provides access to the second compartment and second closure means are mounted adjacent to that opening. An improvement is found in the bag wherein one first compartment end panel which is positioned between the first and second compartment includes an opening therein and has a first expansible bag of flexible material secured along its opening edge to the periphery of that opening on the one panel to define a first expansible compartment which is adapted to expand at least one of the sizes of the first and second compartments on the bag.

It is therefore an object of the present invention, generally stated, to provide a tube-like sports bag having improved storage capacity, and especially improved storage for the separation of fresh clothing from worn clothing.

BRIEF DESCRIPTION OF THE DRAWINGS

The features of the present invention, which are believed to be novel, are set forth with particularity in the appended claims. The invention may best be understood from the following detailed description of currently preferred embodiments thereof, taken in conjunction with the accompanying drawings, wherein:

FIG. 4 is a detail perspective view of an end compartment of a second embodiment of the present invention wherein that compartment includes a smaller expansible compartment suitable for holding an umbrella therein, and has organizer pockets positioned therein.

FIG. 5 is a detail perspective view of the opposing end of the second embodiment shown in FIG. 4 wherein the large expansible waterproof compartment includes a zippered cover over the opening thereof.

DETAILED DESCRIPTION OF THE PREFERRED EMBODIMENTS

Figure 1:
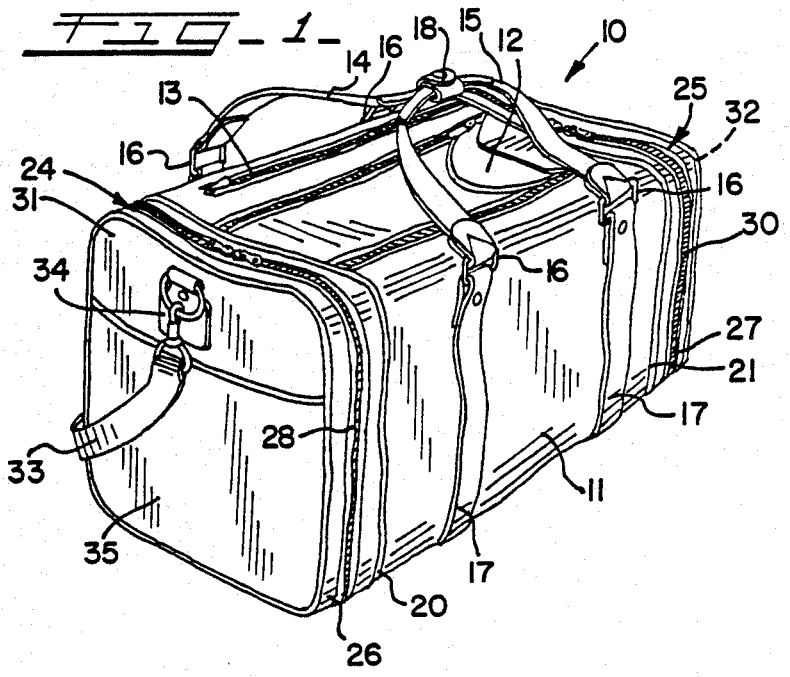
FIG. 1 is a perspective view of a sports bag, constructed in accordance with the present invention, shown in a closed condition.

Referring to FIG. 1, a preferred embodiment of a duffel or roll-type bag 10, constructed in accordance with the present invention, includes a generally rectangular side-wall 11 formed or rolled into a tubular shape and which may include a soft rolled bottom, or a stiff, reinforced generally flat bottom wall (not shown) as desired. In this embodiment, the sidewall 11 is rolled into a somewhat square tube having rounded corners with the top portion of the sidewall including a dual zippered cover panel 12. Additionally, the top of the rolled side panel includes a slide fastener 13 defining the upper boundary of a generally vertical side pocket in the bag which runs substantially the entire length of the main compartment defined by the side panel 11. This embodiment of the present invention includes a dual saddle strap handle including a pair of U-shaped straps 14, 15 which are anchored inwardly adjacent the four corners of the top of bag 10 by metal rings 16—16. The rings 16—16 are attached, in turn, to strengthening straps 17—17 which are anchored to the side of of bag sidewall 11. Straps 14–15 are joined at the their central or bight portion by a selectively releasable loop 18.

Figure 2:
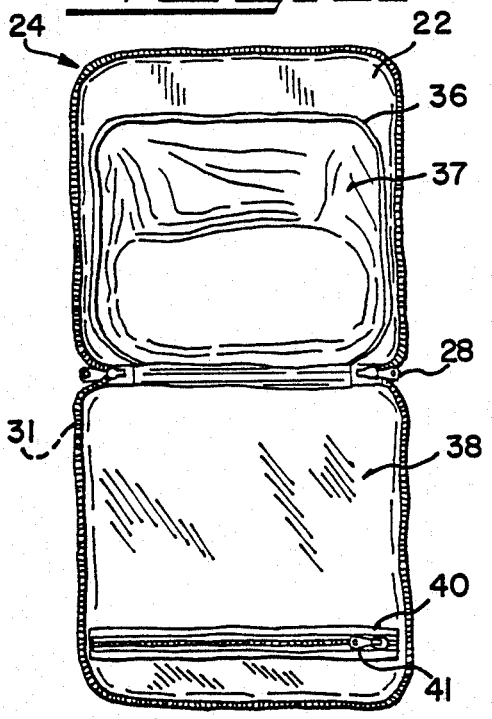
FIG. 2 is an end elevational view of the sports bag with the end compartment opened showing the expansible dividing wall-pocket therein.
Figure 3:
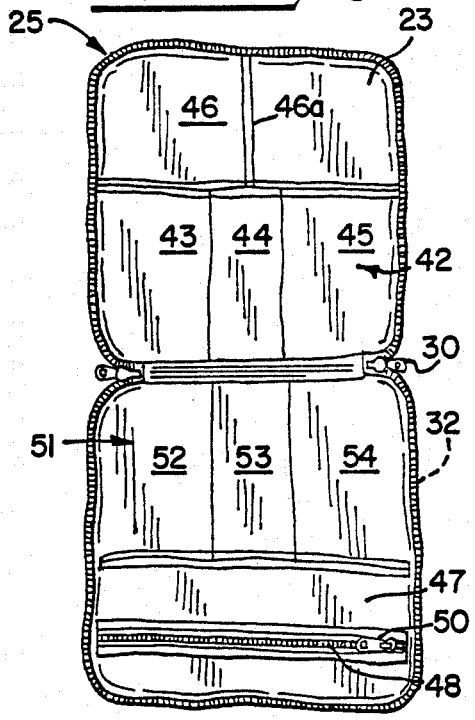
FIG. 3 is an end elevational view of the opposing smaller compartment on the sports bag of the present invention shown in an open position disclosing a plurality of pockets in an organizer-compartment.

In the embodiment shown in FIG. 1, circumferential piping 20–21 defines the end boundaries of a main compartment formed by rolled sidewall 11. The actual opposing end walls 22, 23 of the main compartment are shown in FIGS. 2 and 3, respectively, and will be discussed in greater detail below. Outwardly adjacent the opposed end walls 22, 23 are positioned two opposing smaller compartments 24, 25 which each include a rolled bifurcated sidewall 26, 27, respectively, having a circumferential slide fastener 28, 30 positioned thereon and substantially therearound providing a selectably closeable opening for each of the opposing compartments. Compartments 24 and 25 include opposing end walls 31, 32 (the latter being shown in outline only) which define the outer end boundaries of bag 10. A shoulder strap 33 is releasably attachable to the opposing end walls 31, 32 by matching hook and ring fasteners 34—34 (only one shown) to provide for ease of user carrying. In an additional feature of the present invention, each end wall includes an open top pocket such as shown at 35 which is connected along the remainder of its periphery to the periphery of end wall 31, thus providing a place to removably position articles as the user desires.

Referring to FIGS. 2 and 3, an important feature of the present invention resides in the utilization of the interior of opposed side compartments 24, 25 to provide a combination of business-organizer and work clothing storage capability to the bag. As shown most clearly in FIG. 2, when compartment 24 is opened by means of dual slide fastener 28, the end wall 22 of the main compartment may be seen in full view most clearly. In this embodiment, the vertical end wall 22 has a substantial aperture, the outline of which is shown at 36 in FIG. 2, having an area which is greater than approximately one-half of the size of end panel 22. Outline 36 of the aperture forms a joint with a generally waterproof fabric expandable pocket 37 which preferably extends in the main compartment of bag 10 so as to expand the size of compartment 24 as desired. Waterproof pocket 37 may be utilized for placing worn athletic or other clothing, shoes, etc. back into the bag after use while separating them from the remainder of the clothing in the main compartment of bag 10. Additionally, the end wall 31 of compartment 24 has a like-shaped waterproof panel 38 positioned on the inside thereof to define an additional pocket to which access is obtained through opening 40 having a slide fastener 41 affixed thereto. Materials positioned in the pocket defined by end wall 31 and inner waterproof panel 38 are thereby separated from the interior of pocket 37 by the waterproof panel.

Referring to FIG. 3, the end compartment 25 in bag 10 is shaped exteriorly identical to the exterior of compartment 24. However, the interior of compartment 25 as shown most clearly in FIG. 3, includes a plurality of pockets forming an organizer compartment for the bag user. End wall 23 includes a panel 42 which is affixed to the bottom and a portion of the opposing sides of end panel 23 to define 3 pockets, 43, 44 and 45, respectively, therein with access from the open top of each. An additional pocket is formed by the affixation of panel 46 along a portion of the top and one side of the periphery of the end panel 23 leaving a vertical opening 46A to provide access to the pocket. Similarly to end wall 31, end wall 32 includes a waterproof inner panel 47 affixed along the periphery of end wall 32, and includes slit 48 bounded by a slide fastener 50 to define a waterproof pocket in the end panel. Additionally, in a similar manner to panel 42, an additional panel 51 is affixed along the bottom end and peripheral portions of the sides of panel 47 to define three pockets therein 52, 53 and 54, respectively, each having an open top thereto. Therefore, a total of seven open pockets and one closed pocket are found in compartment 25, to provide an organizer capability to the bag 10 of the invention which increases the versatility of the bag for its owner.

Referring to FIGS. 4 and 5, a modification of the end compartments in a bag 60, constructed in accordance with the present invention, includes opposing hollowed shallow half-shell type access covers 61, 62, respectively, each having a slide fastener 63, 64 substantially around the perimeter thereof for fastening the half shell panel to the central compartment portion of bag 60. The inside of each half shell end compartment cover 61, 62 includes a generally waterproof inner panel 65–66 having a slit-type opening 67–68 which is selectably closeable by a slide fastener 70, 71, respectively to provide an additional waterproof pocket in the end compartment of each of the opposing ends of the bag 60.

As shown most clearly in FIG. 4, the end panel 72 of the large central compartment in bag 60 has an aperture 73 therein which is smaller than aperture 36 in end panel 22 of bag 10. Aperture 73 has affixed to its boundary, a hollow waterproof pocket 74 extending into the main compartment, aperture cover 75 adapted to close the aperature, and slide fastener means 76 on the cover 75 and aperture 73 for selectively closing the cover over the pocket. The pocket 74 is sized preferably for fitting a foldable umbrella 77 therein. Additionally, end wall 72 includes, in this embodiment two differing size covered pockets 80, 81, each having snap fastenable covers 80*a* and 81*a* which fit over the top openings thereof to provide sufficient closure means for retaining objects positioned therein as desired by a user.

Referring to FIG. 5, an opposing end wall 82 of the main compartment in bag 60 includes an aperture 83 sized similarly to aperture 36 on end panel 22 of bag 10. Aperture 83 has affixed along the periphery thereof a waterproof pocket 84 extending into the large central compartment of bag 60, an end panel closure 85 permanently attached along the bottom of aperture 83, and a slide fastener 86 for closing panel 85 over aperture 83. As shown most clearly in FIG. 5, pocket 84 is of substantial size so as to allow the positioning of large clothing material such as shoes 87 and towels 88 therein with comfort. In order to provide additional storage space for small user items, pockets 90, 91, 92 and 93 are positioned on the outer surface of cover 85. Thus, a modification of the organizer of the end pockets of the present invention has been shown and described.

While two particular embodiments of the present invention have been shown and described, it will be obvious to those skilled in the art that changes and modifications may be made without departing from the invention in its broader aspects. Therefore, the aim in the appended is to cover all such changes and modifications as fall within the true spirit and scope of the invention.

The invention is claimed as follows:

1. In a tube-like sports bag of the type made of pliable material and including a main storage compartment having two-like shape opposed main compartment end panels and a first generally rectangular side wall being rolled for joinder along its opposed ends to the periphery of respective ones of said end panels for defining at least a portion of the boundaries of said main storage compartment therein, a first opening in said first side wall for providing access to said main compartment and first closure means mounted adjacent said first opening, means mounted on said side wall for user carrying of said bag;

a second rolled side wall extending laterally from one of said opposed end panels between said first side wall and one of said main compartment end panels, and a third like-shape end panel joined to said second side wall along an outward end thereof and enclosing same for forming a second compartment on said bag, a second opening in said second side wall for providing access to said second compartment and second closure means mounted adjacent said second opening; and an improvement wherein said one main compartment end panel positioned between said main and said second compartments includes a third opening therein and a first expansible bag of flexible material secured along an open top edge thereof to the periphery of said third opening defining a first expansible chamber adapted to expand the size of at least one of said main and said second compartments on said bag.

2. The tube-like sports bag as defined in claim 1 wherein said third opening is an oval-like shape, and the material of said expansible bag is water repellant.

3. The tube-like sports bag as defined in claim 1 wherein said second opening in said second compartment side wall is positioned circumferentially and extends substantially completely across a top portion and along the opposing side portions of said second wall, and a remaining bottom portion of said second side wall being pliable for acting as a hinge when said second compartment is in opened position to gain access to said expansible chamber.

4. The tube-like sports bag as defined in claim 1 wherein said third like-shape end panel includes a pair of layered panels connected along their peripheries, an interior panel of said pair of layered panels being made of substantially water resistant material, including an opening therein, and having closure means mounted adjacent said opening to define a generally disc shape pocket in said compartment.

5. The tube-like sports bag as defined in claim 1 further including a third rolled side wall extending laterally from the other of said opposed end joinders between said first side wall and the other of said main compartment end panels, and a fourth like-shape end panel joined to said third side wall along an outward end thereof and enclosing same for forming a third compartment on said bag.

6. The tube-like sports bag as defined in claim 5 wherein at least one of said end panels forming said third compartment includes pocket forming means thereon for retaining any material positioned therein.

7. The tube-like sports bag as defined in claim 2 wherein said oval-like shape third opening includes a complementary shape cover and means adjacent the periphery of each of said cover and one end wall adjacent said opening for selectably fastening same together.

8. The tube-like sports bag as defined in claim 1 wherein said third opening in said one end panel is of an area less than about one-half the area defining said one end panel, and said one end panel additionally includes pocket means thereon for retaining items positioned therein.

9. The tube-like sports bag as defined in claim 1 wherein said third opening in said one end panel is of an area more than about one-half of the area defining said one end panel.

10. The tube-like sports bag as defined in claim 5 wherein the other of said main compartment end panels includes a fourth opening therein and a second expansible bag of flexible material is fastened along its opening edge to the periphery of said fourth opening on said other end panel to define a second expansible compartment.

11. In a tube-like sports bag of the type made of pliable material and including a main storage compartment having two-like shape opposed main compartment end panels and a first generally rectangular sidewall being rolled for joinder along its opposed ends to the periphery of respective ones of said end panels for defining at least a portion of the boundaries of said main storage compartment therein, a first opening in said first sidewall for providing access to said main compartment and first closure means mounted adjacent said first opening, means mounted on said sidewall for user carrying of said bag;

a second rolled sidewall extending laterally from one of said opposed end panels between said first sidewall and one of said main compartment end panels, and a third like-shape end panel joined to said second sidewall along an outward end thereof and enclosing the same for forming a second compartment on said bag, a second opening in said second sidewall for providing access to said second compartment and second closure means mounted adjacent said second opening; and an improvement wherein said one main compartment end panel positioned between said main and said second compartments includes a third opening therein and a first expansible bag of flexible material secured along an open top edge thereof to the periphery of said third opening defining a first expansible chamber adapted to selectively expand the size of said main compartment or said second compartment on said bag, said second opening in said second sidewall being positioned circumferentially and extending substantially across the top portion and along the opposing side portions of said second sidewall, and a remaining bottom portion of said second sidewall being pliable for acting as a hinge when said second compartment is in opened position to gain access to said expansible chamber.

* * * * *